US005388180A

United States Patent [19]

Bayles

[11] Patent Number: 5,388,180

[45] Date of Patent: Feb. 7, 1995

[54] ELECTRICAL STEAM GENERATOR WITH MULTIPLE PASSAGES OF UNEQUAL CROSS-SECTION

[75] Inventor: Peter W. Bayles, Durham, England

[73] Assignee: Black & Decker Inc., Newark, Del.

[21] Appl. No.: 942,670

[22] Filed: Sep. 9, 1992

[30] Foreign Application Priority Data

Sep. 14, 1991 [GB] United Kingdom ..... 9199693

[51] Int. Cl.[6] ..... B44C 7/02; D06B 19/00; D06F 75/18; F22B 1/28

[52] U.S. Cl. ..... 392/484; 392/396

[58] Field of Search ..... 38/77.1-77.9, 38/69, 74, 75; 392/386, 394, 396, 397, 399, 403-406

[56] References Cited

U.S. PATENT DOCUMENTS

| | | | |
|---|---|---|---|
| 1,384,301 | 7/1921 | Buskard | 38/77.6 |
| 1,687,562 | 10/1928 | Hoffman | 38/77.6 |
| 1,985,546 | 12/1934 | Nosarzewski | 392/396 |
| 2,010,331 | 8/1934 | Starrick | 392/396 |
| 2,059,620 | 7/1934 | Abrams et al. . | |
| 2,145,287 | 1/1939 | Beyrodt | 392/397 |
| 2,271,289 | 1/1942 | Dowinsky | 38/77.6 |
| 2,272,341 | 2/1942 | Holzapfel | 392/396 X |
| 2,278,370 | 3/1942 | Hoffman | 38/77.9 |
| 2,294,578 | 9/1942 | Shapiro et al. | 392/399 |
| 2,427,264 | 9/1947 | Dowinsky | 38/77.9 |
| 3,814,901 | 6/1974 | Morhack | 392/399 X |
| 3,852,899 | 12/1974 | Mackey | 38/77.83 |
| 4,077,143 | 3/1978 | Walker et al. . | |
| 4,255,646 | 3/1981 | Dragoy et al. | 392/399 X |
| 4,532,412 | 7/1985 | Birocchi | 38/77.9 X |
| 4,857,703 | 8/1989 | Wilkins . | |
| 4,990,745 | 2/1991 | Bayles et al. . | |

FOREIGN PATENT DOCUMENTS

| | | | |
|---|---|---|---|
| 0159134 | 3/1985 | European Pat. Off. . | |
| 0245641 | 11/1987 | European Pat. Off. . | |
| 2205595 | 5/1974 | France . | |
| 3545753 | 6/1987 | Germany . | |
| 553839 | 6/1943 | United Kingdom | 38/77.82 |
| 655509 | 7/1951 | United Kingdom . | |
| 2067600 | 1/1981 | United Kingdom . | |

*Primary Examiner*—Bruce A. Reynolds
*Assistant Examiner*—John A. Jeffery
*Attorney, Agent, or Firm*—Dennis A. Dearing; John D. Del Ponti; Charles E. Yocum

[57] ABSTRACT

A steam generator has a body (4) of heat conductive material, an electric heating element (6) located within the body (4), an inlet (14) for water to be vaporized, one or more discharge orifices (20) for steam, and one or more elongate convoluted passageways (26) serving to transfer water and/or steam from the water inlet (14) to the one or more steam discharge orifices (20). The steam generator has first and second chambers (8), (22). The first chamber (8) has relatively wide passageways (12) serving to remove substantially any impurities present from, and preheat, the water, to produce steam which contains entrained water droplets, and which is substantially free from impurities. The second chamber (22) has relatively narrow and convoluted passageways (26) to achieve final heating of the steam to convert any entrained water droplets to steam. The first and second chambers are connected by transfer passages (16, 16A) allowing passage of steam containing entrained 20 water droplets from the first chamber (18) to the second chamber (22).

11 Claims, 3 Drawing Sheets

ELECTRICAL STEAM GENERATOR WITH MULTIPLE PASSAGES OF UNEQUAL CROSS-SECTION

FIELD OF THE INVENTION

The invention relates to a steam generator, especially a steam generator for use in a hand-held tool such as a wallpaper stripper or crease remover.

BACKGROUND OF THE INVENTION

Hand-held tools such as wallpaper strippers and crease removers must be capable of effective use in a number of different orientations and, with some prior proposals, it is found that in certain orientations hot water might possibly be ejected from the steam nozzles of the tool. This reduces the effectiveness of the tool and may possibly be hazardous to the user. It is also found that, in prior proposals, because of the impurities present in water there is a tendency for particles to be deposited in the steam passageways and to pass to the steam nozzles where the particles may block the nozzles and again this may reduce the effectiveness of the tool.

Steam generators for wallpaper strippers are described in U.S. Pat. Nos. 4,990,745 and 4,857,703, the disclosures of both of which are hereby incorporated by reference. These generators comprise a body of heat conductive material with an electric heating element housed within the body. A number of passageways are formed within the body, extending from a water inlet to outlets for steam. Steam is generated on one side only of the generator, and the maximum nominal rate of steam production which can be obtained using generators of this type to obtain steam with very few or no water droplets is about 25 cc per minute. Ideally, the water should be changed completely to steam.

In order to increase the rate of steam production significantly above the rate of approximately 25 cc per minute, using the steam generators of the above U.S. Patents, two alternative possible approaches appear possible.

One approach which might be considered is to attempt to increase the path length, and hence the time for which the water is in contact with the heating element, by making the tracks smaller and more convoluted. However, since the water contains dissolved and suspected impurities which are precipitated out by boiling, the problem arises that particles will build up in the tracks which become restricted, or the heat transfer becomes less efficient. This by itself then is not a practical solution.

In an alternative approach, consideration could be given to increasing the temperature of the casting. This would have the result of increasing the volume of steam production, but would risk over-heating of the housing. The housing is preferably made from a plastics material; the available type of thermostat used in wallpaper strippers, etc., would then be set to operate at a nominal temperature of 160 degrees C., with a tolerance of $\pm 7$ degrees C., and this is around the practical temperature limit for a plastics housing.

SUMMARY OF THE INVENTION

It is an object of the present invention to provide a steam generator, for example for a wallpaper stripper or other handheld appliance, of improved design, with an increased rate of steam production, in which the above disadvantages are reduced or substantially obviated.

According to one aspect of the present invention, there is provided a steam generator comprising a body of heat conductive material, an electric heating element located within the body, an inlet for water to be vaporized, one or more outlets for steam, and one or more elongate convoluted passages serving to transfer water and/or steam from the inlet to the one or more outlets for steam. The steam generator comprises first and second chambers. The first chamber has relatively wide passages serving to remove substantially any impurities present from, and preheat, the water, to produce steam which contains entrained water droplets, and which is substantially free from impurities. The second chamber has relatively narrow and convoluted pathways to achieve final heating of the steam to convert any entrained water droplets to steam. Means is provided for connecting the first and second chambers, and serving to allow passage from the first chamber to the second chamber of steam containing entrained water droplets.

In a preferred embodiment of the steam generator according to the invention, the relatively wide passageways of the first chamber are defined by a system of ribs such that, independent of the orientation of the generator, water flows through the chamber substantially without standing in any area and causing local cooling of the element.

In a particularly preferred embodiment of the steam generator according to the invention, the first chamber is positioned on the generator in a position which is on the "outside" when the generator is mounted in a wallpaper stripper or other tool. This enables the first chamber to be easily accessible for cleaning should this be necessary.

The first and second chambers are preferably positioned on opposite sides of the generator, with the electric heating element located between the two chambers.

According to another aspect of the invention there is provided a steam generator having a block of heat conduction material, first and second chambers located in opposite sides of the block, a heating element in the body and disposed between the chambers, a first cover plate secured to the block and closing over the first chamber and a second cover plate secured to the block and closing over the second chamber. A first path extends through the first chamber, and a second path extends through the second chamber, the first path being wide relative to the second path. A water inlet at one end of the block, this water inlet passing in through the second cover plate and communicating with a beginning of the first path for introducing water to be converted to steam. Connecting means in the block, connect an end of the first path to a beginning of the second path and a steam outlet communicating with an end of the second path. The steam outlet discharges steam around at least part of a periphery of the first cover plate via a peripheral groove in the block with the connecting means being located at the one end of the block, and the end of said second path being located at an opposite end of the block.

Preferably, the first and second paths are convoluted, the first path generally running and doubling back on itself in a lengthwise direction of the block, and the second path generally zig-zagging across the block in a direction transverse to the lengthwise direction.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
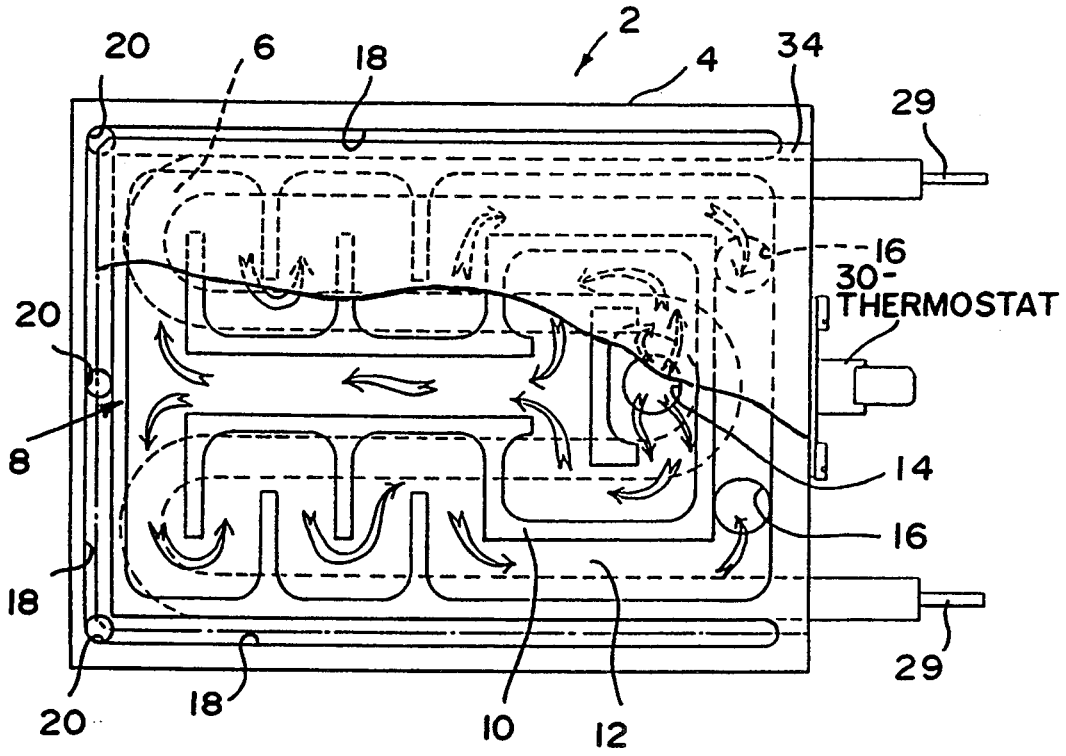
FIG. 1 is a plan view from below of the generator with a lower cover plate partially broken away to show the first chamber.

As can be seen from FIG. 1, a steam generator 2 comprises a body 4, which may be rectangular 2, of heat conductive material, and an electric heating element 6 located within the body 4. The generator 2 comprises a first and lower chamber 8 having a system of upstanding ribs 10 which define convoluted passageways 12. Chamber 8 may be formed as a recess in body 4. A water inlet 14 is located towards one end of the chamber 9 and is connected by the passageways 12 to two outlets 16. A groove 18 with steam inlets 20 is located around three sides of the periphery of the base of the body 4 of the generator 2.

The body 4 further comprises a second and upper chamber 22 located on the opposite side of the heating element 6 to the first chamber 8. Chamber 22 may also be formed as a recess in body 4. A system of ribs 24 located in the upper chamber 22 define an arrangement of narrow convoluted passageways 26. The outlets 16 from the first chamber 8 terminate in the second chamber 22 as two inlets 16A for steam containing entrained water. The convoluted passageways 26 terminate in a groove 28 located at the end of the generator 2 remote from the water inlet 14. The groove 28 is provided with three outlets 20A which are themselves the upper ends of the inlets 20 provided in the peripheral groove 18 of the generator as discharge orifices 20 for steam.

Figure 3:
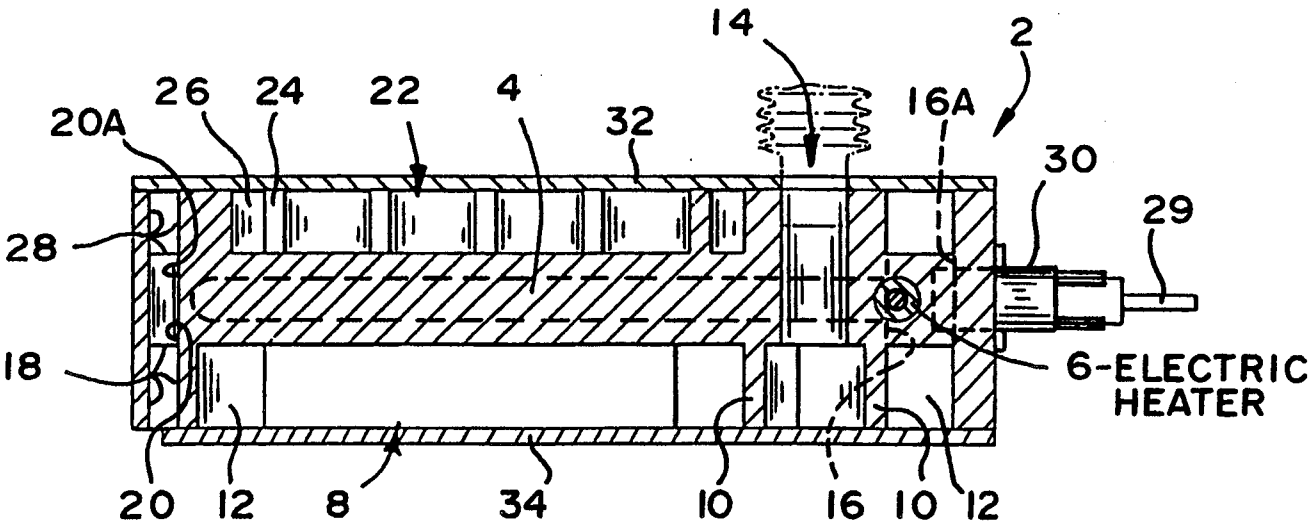
FIG. 3 is a section on the line III—III of FIG. 2.

The upper and lower chambers 22, 8 have their open faces closed by cover plates 32 and 34 removably secured to the metal body 4, as can be seen in FIG. 3. The upper cover plate 32 has the water inlet 14 therethrough. The lower cover plate 34 stops short of three sides of the base of the body 4 to allow steam to escape from the U-shaped groove 18 around the base of the body 4.

The electric heating element 6 is provided with electrical connections 29 for connection to a source of electrical power (not shown), and is controlled in known manner by means of a thermostat 30.

Figure 2:
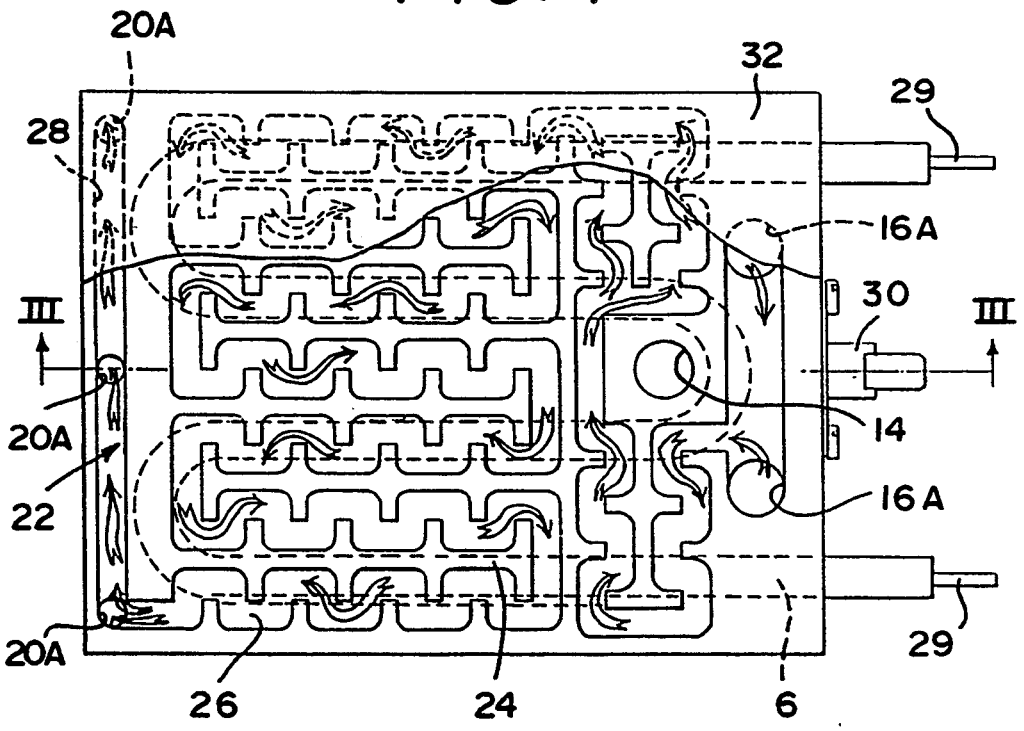
FIG. 2 is a plan view from above of the generator with an upper cover plate partially broken away to show the second chamber.

In operation, water enters the generator 2 at the inlet 14 and circulates around the passageways 12 of the first chamber 8, where it is heated and partially vaporized, and substantially all impurities are precipitated. The water vapor then passes through the outlets 16 and on through inlets 16A to the second chamber 22. The water vapor then circulates around the narrow convoluted passageways 26 of the second chamber 22 where it is further heated and all or substantially all entrained water droplets are vaporized. The steam then leaves the second chamber 22 through the outlets 20A and passes to and through the inlets 20 communicating with the peripheral groove 18 located in the same side of the generator 2 as the first chamber 8. The inlets 20 into the groove 18 thus form steam discharge orifices 20 on the underside of the steam generator 2. These steam discharge orifices 20 communicate with the peripheral groove 18 to provide distribution of the steam around three sides of the base of the steam generator when the base is placed against a flat surface, e.g. wallpaper on a wall, or a garment on an ironing board. Such flat surface may, however, be a separate bottom plate of the hand-held appliance, this bottom plate containing the final steam outlets (along the lines shown in FIGS. 2, 3 and 4 of the above referenced U.S. Pat. No. 4,990,745).

Figure 4:
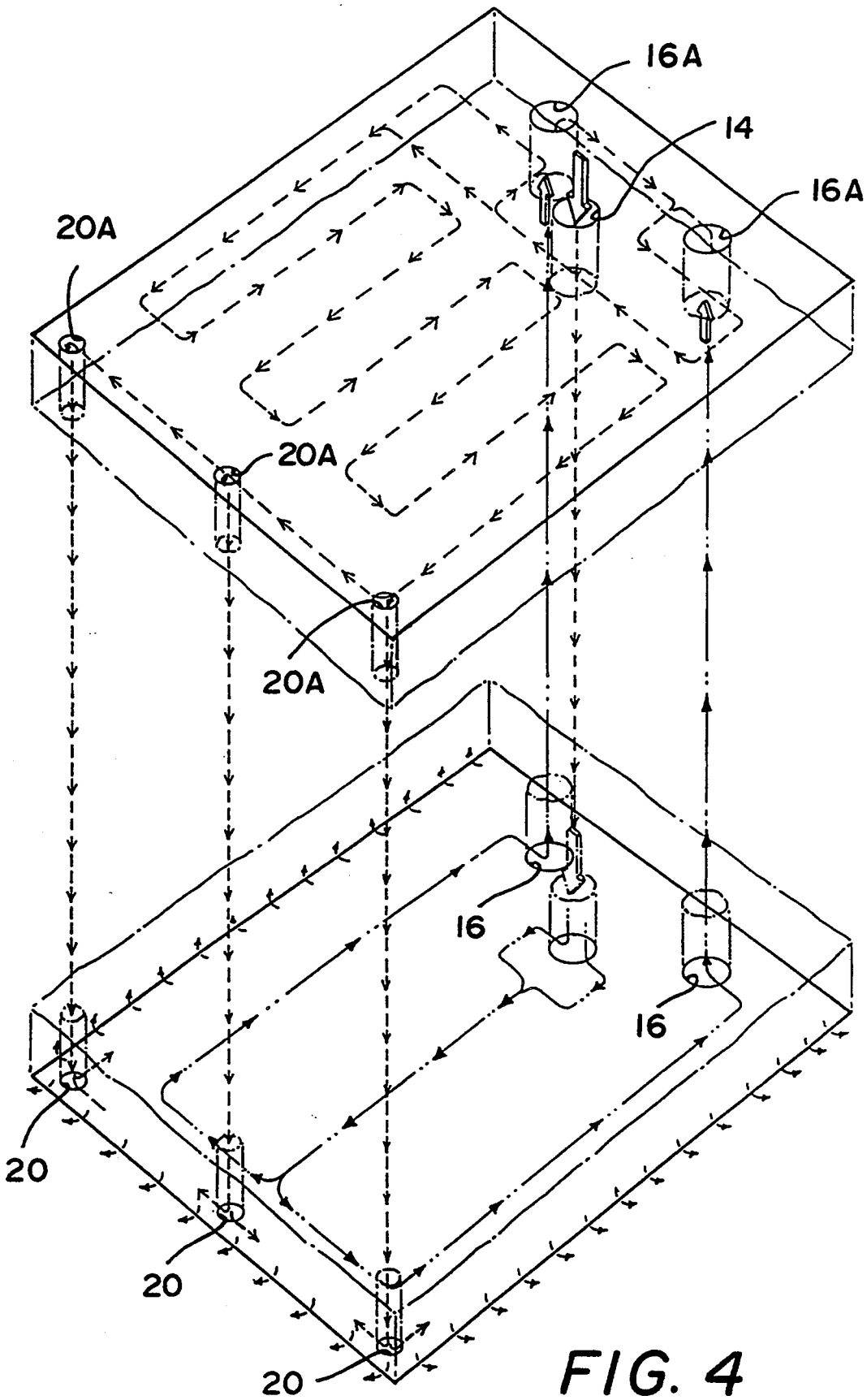
FIG. 4 is an exploded schematic diagram showing the flow of water and steam within the generator.

As can be appreciated from FIG. 4 of the accompanying drawings, and following the arrows, the water is fed in through the water inlet 14, drops to the lower chamber 8 where it starts being converted to steam as it follows a single path along substantially the length of the generator before dividing into two paths which lead back again to the first chamber outlets 16. The steam, and any entrained water, then pass upwards into the upper chamber 22 and pass in an elongated and narrower serpentine-like path throughout the upper chamber where further heating occurs, the path zig-zagging across the width of the upper chamber. The steam then passes downwards through the second chamber outlets 20A to the steam inlets 20 into the groove around three sides of the common base plate of the first chamber and the steam generator, the small curved arrows showing the steam escaping finally from the generator around three lower edges.

The first chamber 8 forms a pre-chamber and is designed such that the cross-sectional area of the relatively larger passageways 12 is large enough to avoid being blocked by and filled with hard water deposits, yet small enough and with a sufficiently long path to enable almost all of the water to be converted to steam. The initial path is straight in one direction and then divides transversely into two paths 12 with the two paths 12 returning in the opposite direction. The paths 12 are convoluted and shaped to cause entrained water droplets and steam to change direction frequently to break up droplets, rather than being carried along with the fast moving vapor and not touch the heated sides and floor of the passageways. Most of the impurities from the water are deposited in the first chamber, and the ribs and partitions prevent large pools of water being able to form.

The second chamber 22 is even more convoluted to provide a large surface area and cause continuous contact with this heated surface area to transmit as much heat as possible into the water vapor and complete conversion into steam.

In general, the water is converted to steam and deposits trapped in the first heated chamber 8, then the steam is further dried in the second heated chamber 22, with a common heating element 6 being disposed between the two chambers.

Suitable dimensions for the steam generator of the present invention when used in a wallpaper stripper as shown and described in the above referenced U.S. Pat. No. 4,990,745 are 125 mm long, 95 mm wide, and 35 mm deep. The electric heating element would be 2400 Watts, and the rate of water flow through the water inlet into the lower chamber would be controlled at a pumping rate of 50 cc per minute.

The above described embodiments, of course, are not to be construed as limiting the breadth of the present invention. Modifications, and other alternative constructions, will be apparent which are within the spirit and scope of the invention as defined in the appended claims.

What is claimed:

1. A steam generator, comprising: a body of heat conductive material having a top side and an underside;

an electric heating element located in said body;

said body containing a first chamber and a second chamber with said heating element disposed between said chambers;

said first and second chambers each having at least one convoluted passageway therethrough with the first chamber passageway being wider than said second chamber passageway;

a water inlet in said body and communicating with said first chamber passageway;

a steam outlet from said body and communicating with said second chamber passageway;

at least one passage connecting said first chamber passageway to said second chamber passageway;

said first chamber being disposed below said second chamber;

said water inlet passing downwards through said second chamber past said heating element into said first chamber; and said steam outlet commencing in said second chamber, passing downwards past said first chamber, and communicating with said underside of said body.

2. The steam generator of claim 1, wherein said heating element is of serpentine form, and is embedded in a portion of said body separating said first chamber from said second chamber.

3. The steam generator of claim 2 wherein said first chamber includes a cover plate detachably connected to said underside of said body remote from said second chamber.

4. The steam generator of claim 1, wherein said first chamber opens downwardly and is closed by a cover plate, and said steam outlet includes a groove around at least a portion of a periphery of said first chamber with said cover plate partially covering said groove.

5. A steam generator, comprising:

a block of heat conductive material;

first and second chambers recessed in opposite sides of said block and open to the outside;

a heating element disposed in said body between said chambers for heating both chambers;

a first cover plate secured to said block and closing over said first chamber;

a second cover plate secured to said block and closing over said second chamber;

a first flow path through said first chamber;

a second flow path through said second chamber;

said first path being wide relative to said second path;

a water inlet at one end of said block, said water inlet passing in through said second cover plate and said second chamber and communicating with a beginning of said first path for introducing water to be converted to steam;

means, in said block, for connecting an end of said first path to a beginning of said second path;

a steam outlet communicating with an end of said second path;

said steam outlet discharging steam around at least part of a periphery of said first cover plate via a peripheral groove in said body; and said connecting means being located at said one end of said block, and said end of said second path being located at an opposite end of said block.

6. The steam generator of claim 5, wherein said first and second paths are convoluted, said block being rectangular and having a length and a width, said first path extending lengthwise of said block in a first direction and reversing so as to extend in a second, opposite direction along the length of said block, and said second path includes serpentine portions extending parallel to said length and positioned in rows across the width of said block.

7. A hand-held steam generator for generating relatively dry steam from water comprising:

(a) a body of heat conductive material having first and second sides, (b) electric heating means disposed within said body for heating said body, (c) means forming a first steam chamber adjacent said first side of said body in heat transfer relationship with said heating means, (d) means forming a second steam chamber adjacent said second side of said body in heat transfer relationship with said heating means, (e) first chamber passage means for generating relatively wet steam and flowing said relatively wet steam through said first steam chamber, said first chamber passage means having a cross-sectional area sufficiently large such as to prevent clogging by impurities in said water being deposited therein, (f) second chamber passage means for flowing relatively dry steam through said second steam chamber, said second chamber passage means having a cross-sectional area substantially smaller than the cross-sectional area of said first chamber passage means, first connecting passage means for passing relatively wet steam from said first chamber passage means through said body to said second chamber passage means, means forming a U-shaped steam outlet adjacent said first steam chamber, second connecting passage means for passing relatively dry steam from said second chamber passage means through said body to said U-shaped steam outlet, and water inlet means for introducing water to said first chamber passage means, said water inlet means extending through said second chamber and said body to said first chamber and communicating with said first chamber passage means.

8. The steam generator of claim 7 wherein said body has upper and lower sides, said first side being said lower side and said second side being said upper side, said first steam chamber and said U-shaped steam outlet being adjacent said lower side, and the inlet of said water inlet means and said second steam chamber being adjacent said upper side.

9. The steam generator of claim 8 wherein said first chamber passage means comprise at least one portion extending through said body in a first direction and at least two additional portions extending in the direction opposite to said first direction, said two additional portions being of serpentine shape, and wherein said second chamber passage means comprise a plurality of passages zig-zagging in opposite directions in a serpentine path formed by a plurality of ribs extending from said body.

10. The steam generator of claim 7 Wherein said first chamber passage means comprise at least one portion extending through said body in a first direction and at least two additional portions extending in the direction opposite to said first direction, and said two additional portions being of serpentine shape.

11. The steam generator of claim 7 wherein said second chamber passage means comprise a plurality of passages zig-zagging in opposite directions in a serpentine path formed by a plurality of ribs extending from said body.

* * * * *